US007067039B2

(12) United States Patent
Almi et al.

(10) Patent No.: US 7,067,039 B2
(45) Date of Patent: Jun. 27, 2006

(54) METHOD AND EQUIPMENT IN CONNECTION WITH A PAPER MACHINE OR A PAPER WEB FINISHING APPARATUS

(75) Inventors: Jari Almi, Pirkkala (FI); Pekka Höyssä, Vesilahti (FI)

(73) Assignee: Metso Automation OY, Helsinki (FI)

( * ) Notice: Subject to any disclaimer, the term of this patent is extended or adjusted under 35 U.S.C. 154(b) by 326 days.

(21) Appl. No.: 10/338,449

(22) Filed: Jan. 8, 2003

(65) Prior Publication Data

US 2003/0155395 A1 Aug. 21, 2003

(30) Foreign Application Priority Data

Jan. 8, 2002 (FI) ..... 20020029

(51) Int. Cl.

| | |
|---|---|
| ***B65H 23/188*** | (2006.01) |
| ***B65H 43/00*** | (2006.01) |
| ***D21F 7/02*** | (2006.01) |
| ***D21G 9/00*** | (2006.01) |
| *D21F 7/04* | (2006.01) |

(52) U.S. Cl. ..... 162/193; 162/197; 162/198; 162/263; 162/283; 162/204; 162/DIG. 10; 162/253; 226/24; 226/45; 242/413.3; 242/413.9; 34/459; 34/447

(58) Field of Classification Search ..... 162/193, 162/197, 198, 263, 273, 283, DIG. 6, 204–205, 162/DIG. 10–11, 253, 262; 226/7, 91, 92, 226/97.3, 24, 45; 242/410, 413.3, 413.9; 73/159; 34/447, 117, 118, 121, 443–444, 34/459; 700/127–129

See application file for complete search history.

(56) References Cited

U.S. PATENT DOCUMENTS

| | | | | |
|---|---|---|---|---|
| 3,257,734 | A * | 6/1966 | Boadway et al. | 34/422 |
| 3,791,049 | A * | 2/1974 | Smith, Jr. | 34/452 |
| 3,930,934 | A | 1/1976 | Spitz | |
| 3,989,085 | A * | 11/1976 | Crosby | 162/198 |
| 4,314,878 | A * | 2/1982 | Lee | 162/198 |
| 4,474,643 | A * | 10/1984 | Lindblad | 162/198 |

(Continued)

FOREIGN PATENT DOCUMENTS

CA 2415703 A1 * 7/2003

(Continued)

OTHER PUBLICATIONS

Copy of Finnish Official Action for Finnish Priority Appl. No. 20020029, dated Oct. 8, 2002.

*Primary Examiner*—José A. Fortuna
(74) *Attorney, Agent, or Firm*—Alston & Bird LLP

(57) ABSTRACT

A variable representing runnability of a paper web to be manufactured with a paper machine or processed with a finishing apparatus is measured and the speed difference between operational groups of the paper machine and/or the finishing apparatus is adjusted on the basis of the measurement of said variable such that the moisture profile of the paper web is measured substantially along the entire width of the paper web, the minimum and maximum values for moisture are defined on the basis of the moisture profile, a drawing window describing the allowable tension to be directed to the paper web is defined, the lower and upper limits of the drawing window being defined on the basis of the minimum and maximum values for moisture, and the speed difference between the operational groups is adjusted so that the paper web tension is within the range defined by the drawing window.

15 Claims, 2 Drawing Sheets

U.S. PATENT DOCUMENTS

| | | | | | |
|---|---|---|---|---|---|
| 4,495,712 | A | * | 1/1985 | Justus | 34/561 |
| 5,311,672 | A | * | 5/1994 | Kotitschke et al. | 34/117 |
| 5,377,428 | A | * | 1/1995 | Clark | 34/446 |
| 5,542,193 | A | * | 8/1996 | Sims et al. | 34/117 |
| 5,638,611 | A | * | 6/1997 | Oechsle | 34/447 |
| 5,674,551 | A | | 10/1997 | Koskinen et al. | |
| 5,743,024 | A | * | 4/1998 | Oechsle | 34/447 |
| 5,825,653 | A | * | 10/1998 | Huovila et al. | 700/128 |
| 5,862,607 | A | * | 1/1999 | Oechsle | 34/117 |
| 6,024,836 | A | * | 2/2000 | Sollinger et al. | 162/206 |
| 6,106,177 | A | | 8/2000 | Siegl et al. | |
| 6,200,422 | B1 | * | 3/2001 | Shakespeare et al. | 162/198 |
| 6,207,020 | B1 | * | 3/2001 | Anderson | 162/207 |
| 6,352,615 | B1 | | 3/2002 | Tavi et al. | |
| 6,367,164 | B1 | * | 4/2002 | Oechsle et al. | 34/448 |
| 6,482,295 | B1 | * | 11/2002 | Wolf et al. | 162/207 |
| 6,490,813 | B1 | * | 12/2002 | Oechsle | 34/445 |
| 6,584,703 | B1 | * | 7/2003 | Maenpaa et al. | 34/446 |
| 6,613,195 | B1 | * | 9/2003 | Anderson | 162/289 |
| 6,699,362 | B1 | * | 3/2004 | Rautiainen | 162/136 |
| 6,813,941 | B1 | * | 11/2004 | Beuther et al. | 73/159 |
| 6,863,919 | B1 | * | 3/2005 | Maenpaa et al. | 427/8 |
| 2003/0155395 | A1 | * | 8/2003 | Almi et al. | 226/24 |
| 2004/0003906 | A1 | * | 1/2004 | Hermans et al. | 162/202 |
| 2004/0118892 | A1 | * | 6/2004 | Weber et al. | 226/44 |
| 2005/0034831 | A1 | * | 2/2005 | Beuther et al. | 162/198 |

FOREIGN PATENT DOCUMENTS

| | | | | |
|---|---|---|---|---|
| DE | 92 07 656 | | | 9/1992 |
| DE | 199 56 752 | | | 9/2000 |
| DE | 10260814 | A1 | * | 10/2003 |
| EP | 769587 | A2 | * | 4/1997 |
| WO | WO 9854408 | A1 | * | 12/1998 |
| WO | WO-00/77497 | | | 12/2000 |

* cited by examiner

METHOD AND EQUIPMENT IN CONNECTION WITH A PAPER MACHINE OR A PAPER WEB FINISHING APPARATUS

BACKGROUND OF THE INVENTION

1) Field of the Invention

The invention relates to a method in connection with a paper machine or a paper web finishing apparatus, the method comprising measuring a variable representing runnability of a paper web to be manufactured with a paper machine or processed with a finishing apparatus, and adjusting the speed difference between operational groups of the paper machine and/or the finishing apparatus on the basis of the measurement of said variable.

The invention also relates to equipment in connection with a paper machine or a paper web finishing apparatus, the equipment comprising at least one measuring means for measuring a variable representing the runnability of a paper web to be manufactured with the paper machine or processed with the finishing apparatus, and means for adjusting the speed difference between operational groups of the paper machine and/or the finishing apparatus on the basis of the measurement of said variable.

2) Description of Related Art

The production efficiency of a paper machine is directly proportional to its runnability, because disturbances in the runnability of the paper machine correlate directly with the produced paper tons and thus weaken the production efficiency. In order to pass the paper web through the paper machine without problems, the paper web should have a specific running tension throughout its manufacture, which can be achieved by adjusting speed differences between different operational groups of the paper machine by controlling runnability components of the operational groups. If the running tension is not sufficient, the following operational group of the paper machine cannot forward paper at the pace at which the previous operational group transports it. As a result, the paper web folds and breaks. Also a running tension, which is too high, causes the paper web to break. Operational groups of a paper machine include a wire section, a press section, a dryer section, which is typically divided into five or six different operational groups, a calender and a reeler. Runnability components of the operational groups include, for instance, driving rolls and suction rolls driven by an electric motor and transporting the web or felt of the paper machine, and suction rolls driven by an electric motor. In addition, the paper machine comprises freely rotating guide rolls supporting and guiding the web or the felt, and stretcher rolls, which maintain the proper tension of the wire or the felt.

Due to material-technical properties of paper it is not sufficient that the paper is provided with a specific tension only once, but the paper has to be drawn many times at many different points during the manufacture to maintain the tension. When the paper is provided with a specific tension in a certain drawing space, i.e. between the different operational groups, the web tension relaxes very rapidly when the drawing effect ceases and the web has a 'relaxation tension'. To preserve the runnability, the relaxation tension of the paper web must be higher than the required running tension. When the tension is considered, the most critical place is between the press section and the dryer section where the speed difference between the operational groups should typically be 2 to 3% to achieve a specific tension. In the dryer section, as the paper dries, it starts to shrink and forms part of the required running tension by itself, whereby the required speed differences between the different operational groups are considerably smaller. At the end of the dryer section the speed difference can even be negative, because the web has shrunk as a result of the drying.

Drawing of the paper web with different dry solids contents during the manufacture affects the final properties of the paper. During paper manufacture, plastic, elastic and inner elongation occurs in the paper while being drawn. The relations of these components mainly depend on the dry solids content of the web. Plastic elongation takes place when the paper is wet, which means that it occurs chiefly in the press section. As the paper starts to dry, plastic elongation is not so likely to occur as the others are. In the drawing between the press section and the dryer section, paper stretches plastically so that fibers slide into each other, whereupon the fiber kinks straighten out and the web's grid-like structure becomes more regular. As a result, tensile strength of the paper increases. The optimum point can, however, be found for this wet drawing, and when the draw to the web is higher, the web RBA (Relative Bonded Area) decreases and the structure of the web becomes weaker. When the paper starts to dry in the dryer section, hydrogen bonds are formed between the fibers. When the grid-like paper web dries, the web starts to shrink and an inner tension is formed in the web, and the less the web is let to shrink, the higher the tension is. If the moisture content of the paper web is not the same in every point in the width or cross direction of the paper web, different elongation components are stored in the web due to the combined effect of the moisture content and speed differences, which can be detected, for instance, as variations in the web tension when the paper is reeled.

Paper web moisture is thus one of the variables representing the runnability of the paper web. Paper web moisture indicates how great a force is allowed for drawing the paper web between different operational groups, i.e. how big a speed difference can be arranged between different operational groups of the paper machine. DE publication 19 956 752 discloses how speed differences between operational groups of a paper machine are adjusted according to the moisture content of the web. According to the publication, the moisture content of the paper is measured by a moisture sensor arranged in the press section and/or the dryer section and arranged to measure the web moisture only at one point or location in the width direction of the web. On the basis of this point-like moisture information, the drives controlling the speeds of the operational groups of the paper machine are controlled. The point-like measurement involves a big risk, however, that as to the moisture variation in the cross direction of the web, the measurement is carried out at the point where the web moisture content is at its minimum or at its maximum or therebetween. In such a case, the speed differences can be adjusted on false grounds and not according to the real moisture content of the web, whereby compared with the tensile strength of the paper web, the web is easily drawn with too great or too low a force in the drawing spaces, which causes that the web breaks or that the web properties impair.

It is also known that paper web tension is measured in order to adjust speed differences between different operational groups of the paper machine. In a known solution, a paper web tension profile is measured, which is used for defining an average tension for the paper web, according to which the speed differences are adjusted. When the mean tension of the web is used and the tension profile is poor, i.e. highly uneven, the web tension may at some points become too high, which causes the web to break.

BRIEF SUMMARY OF THE INVENTION

The purpose of the present invention is to provide an improved method and equipment for controlling speed differences between operational groups in a paper machine and in paper web finishing apparatuses.

The method of the invention is characterized by measuring the moisture profile of the paper web substantially along the entire width of the paper web, defining the minimum and maximum values for moisture on the basis of the moisture profile, defining a drawing window describing the allowable tension to be directed to the paper web, the lower and upper limits of the drawing window being defined on the basis of the minimum and maximum values for moisture, and adjusting the speed difference between the operational groups so that the paper web tension is within the range defined by the drawing window.

The equipment of the invention is further characterized in that the equipment comprises at least one moisture measuring device for measuring a moisture profile of the paper web substantially along the entire width of the paper web, means for defining the minimum and maximum values for moisture on the basis of the moisture profile, means for defining a drawing window describing the allowable tension to be directed to the paper web, the lower and upper limits of the drawing window being arranged to be defined on the basis of the minimum and maximum values for moisture, and means for adjusting the speed difference between the operational groups so that the paper web tension is within the range defined by the drawing window.

According to the essential idea of the invention, a variable representing the runnability of a paper web to be manufactured with a paper machine or processed with a finishing apparatus is measured and the speed difference between operational groups of the paper machine and/or the finishing apparatus is adjusted on the basis of the measurement of this variable so that the moisture profile of the paper web is measured substantially along the entire width of the paper web, the minimum and maximum values for moisture are defined from the moisture profile, the minimum and maximum values being used for defining a drawing window describing the allowable tension to be directed to the paper web and for defining the lower and upper limits of the drawing window, and the speed difference between the operational groups is adjusted so that the paper web tension is within the range defined by the drawing window. According to an embodiment of the invention, the variable representing the runnability of the paper web is paper web moisture. According to a second embodiment of the invention, the variable representing the runnability of the paper web is paper web tension. According to a third embodiment of the invention, the moisture profile of the paper web is the mean value of two or more moisture profiles measured along the entire width of the paper web. According to a fourth embodiment of the invention, the paper web finishing apparatus is a coating machine.

The invention provides the advantage that the runnability and production efficiency of a paper machine or paper web finishing apparatuses, such as coating machines, winders and sheet cutters and printing machines, improve, since, due to the optimized speed differences, there are less breaks in the paper web. When the total elongation of the web remains low in the paper machine, the quality of the paper improves, which makes the web easier to run in finishing apparatuses or machines used after the web formation. Due to the optimized wet drawing directed to the paper web during paper manufacture, the web strength in the machine direction can also be maximized. When paper web moisture or tension is used as a variable representing the paper web runnability, it can be easily measured particularly in paper machines with current measuring devices measuring moisture or tension. When the paper web moisture profile is defined as a mean value of two or more moisture profiles measured along the entire width of the paper web, moisture variations in the longitudinal direction of the web can easily be taken into account in the minimum and maximum values for the moisture profile, which are used for defining the upper and lower limits for the drawing window.

In this specification, the term 'paper' refers not only to paper but also to board and soft tissue.

BRIEF DESCRIPTION OF THE SEVERAL VIEWS OF THE DRAWINGS

In the following the invention will be described in more detail in the attached drawings, in which FIG. 1 schematically shows a side view of a paper machine, and FIG. 2 schematically illustrates the principle of a solution according to the invention.

DETAILED DESCRIPTION OF THE INVENTION

Figure 1:
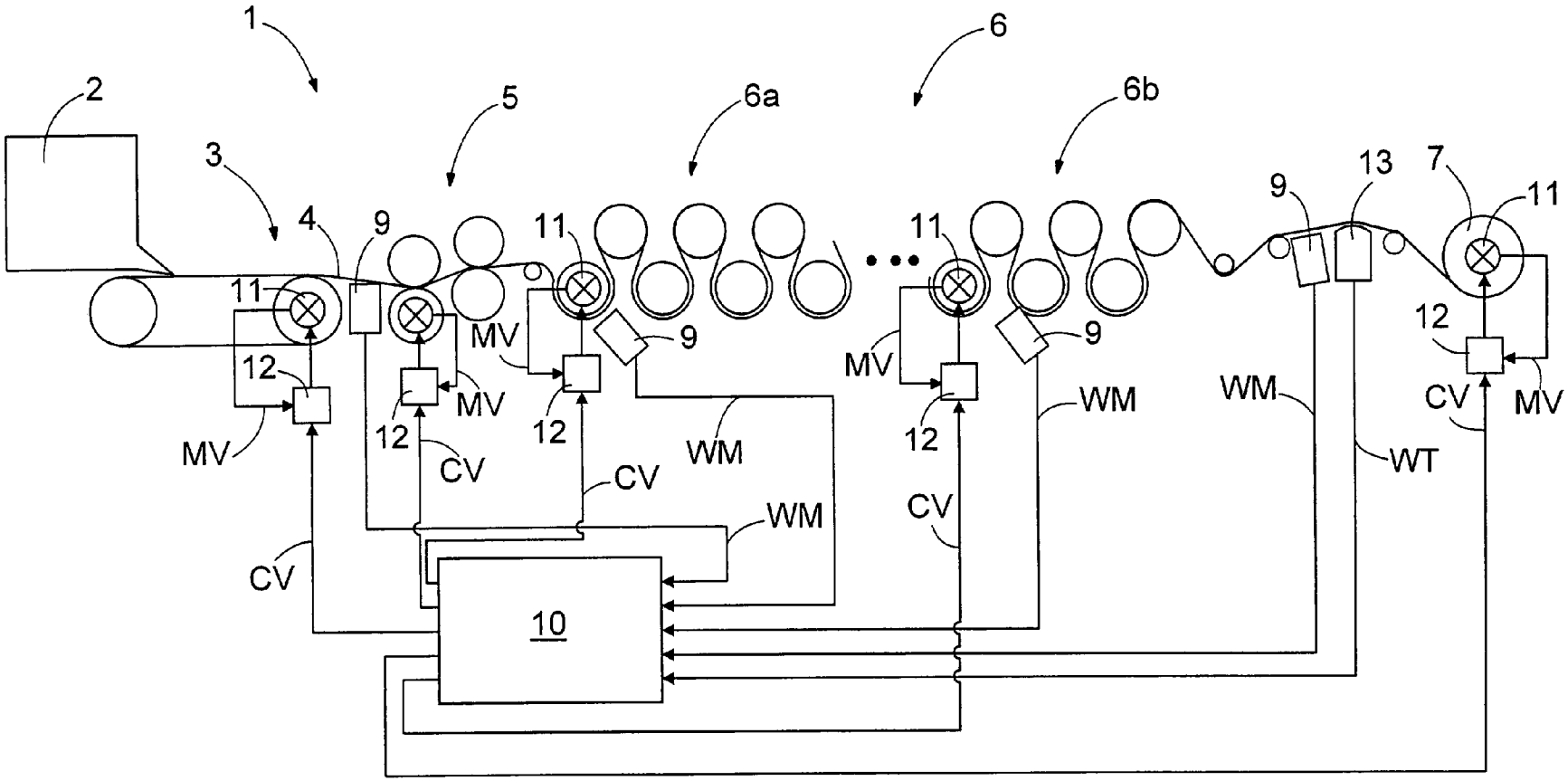

FIG. 1 schematically shows a side view of a paper machine 1. The paper machine 1 comprises a head box 2, from which pulp is fed to a wire section 3, where a paper web 4 is formed from the pulp. The paper web 4 is guided to a press section 5 and further to a dryer section 6. The dryer section 6 comprises several, usually five or six operational groups, FIG. 1 only illustrating the first dryer group 6*a* and the last dryer group 6*b*. From the dryer section 6 the web is guided to a reeler 7. FIG. 1 also shows rolls used for supporting and guiding the paper web 4. The paper machine 1 may also comprise other parts, e.g. a size press or a calender, which are not shown in FIG. 1 for the sake of clarity. The operation of the paper machine 1 is also known per se to a person skilled in the art, for which reason it is not described more closely herein.

To pass the paper web 4 through the paper machine 1 without problems, a specific drawing D or running tension D must be directed to the paper web 4 throughout its manufacture, which is carried out by adjusting speed differences between different operational groups of the paper machine 1. Drawing spaces where a specific drawing is directed to the paper web 4 are typically between the wire section 3 and the press section 5, between the press section 5 and the dryer section 6, between different dryer groups of the dryer section 6, and between the dryer section 6 and the reeler 7 and before the calender. Speed differences between the different operational groups are adjusted by controlling the speeds of runnability components of the operational groups, such as driving rolls driven by an electric motor and transporting the wire or the felt of the paper machine 1, suction rolls driven by an electric motor or the reeler 7, so that a drawing effect is directed to the paper web 4 in the drawing spaces. The drawing effect is produced such that the web speed of the runnability components of the operational group receiving the paper web 4 is higher than that of the operational group supplying the paper web 4. Due to the shrinkage caused by the drying of the paper web 4, the speed difference at the end section of the dryer section 6 can also be negative, whereby the web speed of the runnability components of the operational group receiving the paper web 4 is lower than that of the operational group supplying the paper web 4.

In the solution of the invention, speed differences between the operational groups of a paper machine are controlled on the basis of a variable representing the runnability of the paper web 4. Paper web 4 moisture WM or paper web 4 tension WT can be used as a variable representing the runnability of the paper web 4. In the following, the solution of the invention is examined in a case where paper web 4 moisture WM acts as a variable representing the tensile strength of the paper web 4.

Figure 2:
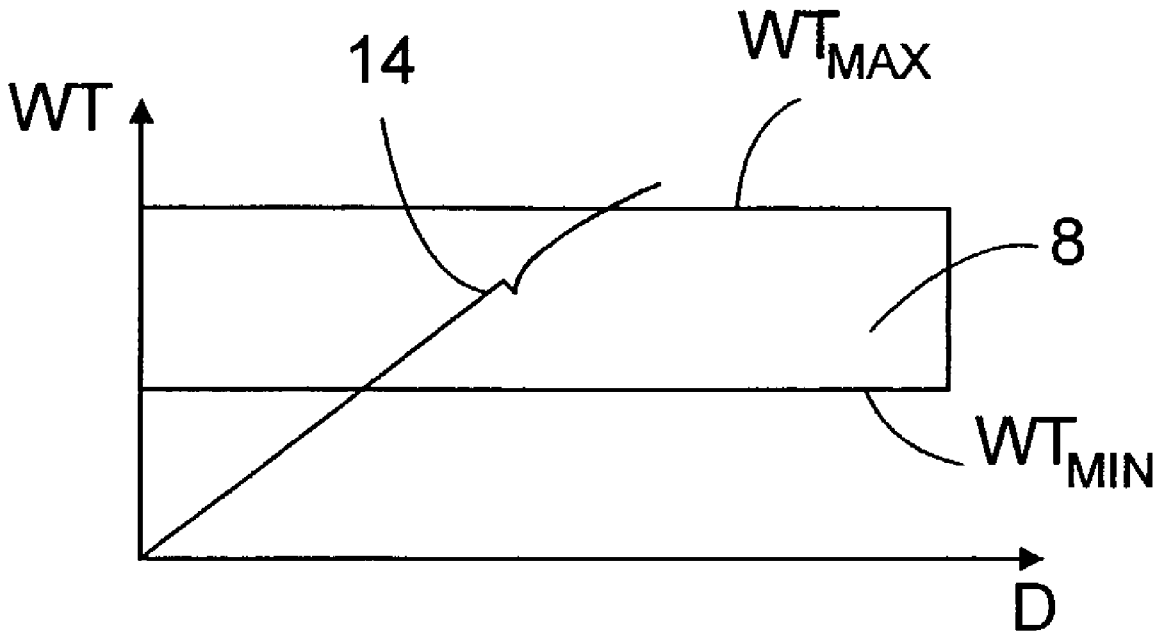

When speed differences are adjusted on the basis of the paper web 4 moisture, a moisture profile of a paper web 4 cross-profile is measured first, which moisture profile is used for defining the minimum value $WM_{MIN}$ and the maximum value $WM_{MAX}$ for web moisture. The minimum value $WM_{MIN}$ and the maximum value $WM_{MAX}$ for web moisture are used for defining a drawing window 8 or a running window 8, on the basis of which the speeds of the operational group can be controlled so that the optimal speed difference is achieved in a specific drawing space. Such a drawing window 8 is schematically illustrated in FIG. 2, where the horizontal axis illustrates drawing D and the vertical axis illustrates web tension WT. The relation of web drawing D to web tension WT, which is schematically illustrated by a graph 14 in FIG. 2, should be in the range indicated by the drawing window 8, so that the optimal speed difference is achieved in a specific drawing space in a manner that will not break the web. The lower limit $WT_{MIN}$ of the drawing window 8 is defined on the basis of the maximum value $WM_{MAX}$ for moisture of the paper web 4 cross profile and the upper limit $WT_{MAX}$ of the drawing window 8 is defined on the basis of the minimum value $WM_{MIN}$ for moisture of the paper web 4 cross profile. The drawing window shown in FIG. 2 can also be such that the horizontal axis illustrates drawing D and the vertical axis illustrates web moisture WM, in which case the maximum value $WM_{MAX}$ for moisture of the web cross profile is used as a lower limit for the drawing window and the minimum value $WM_{MIN}$ for moisture of the web cross profile is used as an upper limit for the drawing window. The maximum value $WM_{MAX}$ and the minimum value $WM_{MIN}$ for moisture of the paper web cross profile or the highest allowable web tension $WT_{MAX}$ and the lowest allowable web tension $WT_{MIN}$ defined on the basis of them act as set values, which set the limits within which the speed difference between the operational groups in different drawing spaces is adjusted.

FIG. 2 shows that if the paper web 4 is drawn too much, the web breaks. Correspondingly, if the web is not drawn sufficiently, the required web tension WT will not be achieved, which also leads to the breaking of the web. The dependence of the required drawing D on the paper web 4 moisture causes that the web must be drawn according to the moistest point in the moisture cross profile so that this web point can also be passed to the next drawing space. Therefore, the lower limit $WT_{MIN}$ for the drawing window 8 is defined on the basis of the maximum value $WM_{MAX}$ for moisture of the web cross profile. However, the web cannot be drawn more than what is allowed by the driest point of the moisture profile, because as the tension of the drier point exceeds the tensile strength of the web, the web breaks. Therefore, the upper limit $WT_{MAX}$ for the drawing window 8 is defined on the basis of the minimum value $WM_{MIN}$ for moisture of the web cross profile. By using the drawing window 8 defined on the basis of the minimum and maximum values $WM_{MIN}$ and $WM_{MAX}$, the runnability of the paper web 4 can thus be optimized so that with a specific minimum value $WM_{MIN}$ for moisture, the speed difference between the operational groups is restricted to be at a certain level so that the web will not break. Correspondingly, with a specific maximum value $WM_{MAX}$ for moisture, the web is drawn a little more, if allowed by the minimum value $WM_{MIN}$ for moisture, in order to achieve the required drawing D. Moisture variations in the longitudinal direction, or machine direction MD of the paper machine 1 can also be taken into account by observing the mean moisture $WM_{MEAN}$ of the moisture profile of the paper web 4 cross profile and by considering the changes in the minimum and maximum values $WM_{MIN}$ and $WM_{MAX}$ for moisture when the speed difference is adjusted. What is observed herein is the real mean moisture and not the effect of a few potential moisture profile peaks on the mean moisture. In practice, the web must be drawn within the drawing window, if the runnability is to be maintained. As the speed increases, the drawing window 8 diminishes and the management of the web moisture profile becomes more challenging. The minimum value $WM_{MIN}$, the maximum value $WM_{MAX}$ and the mean value $WM_{MEAN}$ for moisture of the moisture profile of the paper web 4 cross profile can only be defined on the basis of one measurement of the moisture profile of the paper web 4 cross profile, but preferably these variables are defined on the basis of a mean profile defined on the basis of several successive moisture profile measurements.

The moisture profile of the paper web 4 cross profile is defined by a moisture measuring device 9 arranged in connection with the paper machine 1. The moisture measuring device 9 can be a traversing measuring device where the measuring device is arranged in a measuring carriage, which is included in a measuring frame extending over the width of the paper web 4. Because of space requirements, such a measuring device is usually placed immediately before the reeler 7. With the traversing measuring device, the cross profile of the paper web 4 can be defined once or twice a minute, because the measuring carriage traverses the paper web 4 in 30 to 45 seconds on average. For the sake of clarity, the measuring frame and the measuring carriage are not shown in FIG. 1. A mini-traversing measuring device based on reflection measurement, where the paper web 4 moisture is measured substantially simultaneously along the entire width of the paper web 4, is advantageously used as a moisture measuring device 9 for measuring the moisture profile of the paper web 4 cross profile. This mini-traversing measuring device comprises several measuring heads and measuring channels arranged next to each other and made to move back and forth, i.e. to oscillate part of the distance in the cross direction of the paper web 4. By moving the measuring heads, for instance, about 10 cm back and forth, a 10-meter-wide paper web can be measured substantially at every point by utilizing a hundred measuring channels. By using such a mini-traversing measuring device, the entire cross profile of the paper web 4 can be measured typically in less than a second, so the measurement is considerably faster than in case of using a traversing measuring device. A mini-traversing measuring device can be placed in several different places in the paper machine 1, such as between the wire section 3 and the press section 5, between the press section 5 and the dryer section 6, in the beginning of different dryer sections and between the dryer section 6 and the reeler 7.

If the drying graph of the paper web 4 through the entire paper machine is known, several drawing spaces can be controlled on the basis of the measurement performed by one moisture measuring device 9. If the moisture measuring device 9 is arranged at the beginning of the first dryer section 6*a*, the drawing space between the press section 5 and the dryer section 6 can be adjusted by using feedback control and, correspondingly, the drawing space between the first dryer section 6*a* and the following dryer section can be adjusted on the basis of the same measurement by using feedforward control. Furthermore, the tension profile or tension level of the paper web 4 can be optimized at different stages of the drying by adjusting the speed difference between the different operational groups within the range indicated by the allowable drawing window 8. In such a case, the lower limit $WT_{MIN}$ for the drawing window 8 would be used, for instance, after the press section 5 and the upper limit $WT_{MAX}$ for the drawing window 8 would be used at the end of the dryer section 6, or vice versa.

Speed differences between different operational groups of the paper machine are adjusted by controlling speeds of runnability components of the operational groups, such as driving rolls driven by an electric motor or suction rolls driven by an electric motor, such that a desired drawing D is directed to the paper web 4 in the drawing spaces. In the solution of FIG. 1, moisture measurements supplied by the moisture measuring devices 9 are collected in a centralized control unit 10, which uses the measurements for defining a drawing window 8 for each drawing space to be controlled. On the basis of each drawing window 8 and the measured moisture WM corresponding to the drawing space, the control unit 10 transmits to motor drives 12 controlling electric motors 11 of the runnability components a speed set value CV relating to the electric motor so that the speed differences between different operational groups are optimal for the runnability of the web. The speed set values CV are usually given as relative values so that when the speed of the machine is changed, the tension difference of the paper is maintained and the speed differences need not be changed manually. The electric motors 11 are adjusted by speed control, and the motor drive 12 controlling the electric motor 11 comprises a speed controller, which defines the required speed change by using the set value CV and the speed MV measured from the electric motor 11. The speed MV of the electric motor 11 is usually measured with a speed measuring element, typically a tachometer, arranged on the shaft of the electric motor 11. The static accuracy of the speed controller 11 is usually about 0.01%. For the sake of clarity, FIG. 1 only shows few electric motors 11, and means for measuring current, voltage and speed of the electric motors 11 have been left out from FIG. 1.

The disclosed solution cannot only be utilized in a paper machine but also in various paper web 4 finishing apparatuses, such as coating machines, winders and sheet cutters and printing machines. A finishing apparatus, particularly a coating machine, can also operate on-line so that the paper web 4 is guided from the paper machine 1 directly to the finishing apparatus without breaking the web at any point, and so the disclosed solution is used for adjusting the speed difference between the operational groups of the paper machine and the paper web finishing apparatus.

The invention provides the advantage that the runnability and production efficiency of a paper machine or a paper web finishing apparatus improve, since there are less breaks in the paper web 4 due to the optimized speed differences. Also the quality of the paper improves, because as a result of the optimized speed differences the total elongation of the paper web 4 is lower, which improves the runnability of the web both in finishing apparatuses after the paper machine and in printing machines. Due to the optimized wet drawing directed to the paper web 4, it is also possible to maximize the web strength in the machine direction.

Paper web 4 tension WT can also be used as a variable representing the runnability of the paper web 4. The tension profile of the paper web 4 is measured along the entire width of the web by means of a tension measuring device 13, such as a tension measuring beam, arranged in connection with the paper machine 1. The tension measuring beam comprises a curved measuring bar or orifice plate, which the moving paper web 4 passes so that the web uses the air it carries for forming an air cushion between the web and the orifice plate. Web tension WT can be defined by measuring the force the air cushion applies to the orifice plate or the air cushion pressure, both variables being proportional to the paper web 4 tension WT. In FIG. 1, the tension measuring device 13 is arranged in the paper machine 1 just before the reeler 7, but it can be located in the paper machine 1 also in another place where the paper web 4 is not supported to the wire or the felt. Speed differences between the different operational groups of the paper machine 1 are adjusted by using the drawing window 8 defined on the basis of the paper web 4 moisture and the minimum value $WT_{MINV}$ and the maximum value $WT_{MAXV}$ of the measured tension profile of the paper web 4. The minimum value $WT_{MINV}$ of the tension profile is used for ensuring that the paper web 4 tension cannot become too low, which would cause the paper web 4 to break. The maximum value $WT_{MAXV}$ of the tension profile, in turn, is used for ensuring that the paper tension cannot at some points become too high, which would also cause the web to break. The shape of the tension profile can be used for making a choice which signal is used for tension adjustment. On the other hand, the mean value of the tension profile could also be used for the adjustment so that the operating range of the controller is limited in a way that the minimum or maximum values of the tension profile are not below or over the allowable limits. Like in the moisture measuring device 9, several drawing spaces can be controlled with feedforward and feedback controls by using measurement performed by only one tension measuring device 13.

The drawings and the related description are only intended to illustrate the idea of the invention. In its details, the invention may vary within the scope of the claims. Therefore, it is clear that instead of a centralized control unit 10, drawing spaces can also be controlled by decentralized control units. Regardless of whether one centralized control unit 10 or several decentralized control units are used for controlling the speed differences, the control units are preferably connected to the automation system of the paper machine 1.

That which is claimed:

1. A method in connection with drawing a paper web through at least two operational groups each associated with a paper machine or a paper web finishing apparatus, said method comprising;

defining a moisture profile of the paper web substantially along the entire width of the paper web, defining minimum and maximum values for moisture on the basis of the moisture profile, defining a drawing window having lower and upper limits describing the allowable tension to be drawn on the paper web, the lower and upper limits of the drawing window being defined on the basis of the minimum and maximum values for moisture, and adjusting the speed difference between the operational groups on the basis of the moisture of the paper web so that the paper web tension is within the range defined by the drawing window.

2. A method as claimed in claim 1, wherein the upper limit for the drawing window is defined on the basis of the minimum value for the moisture profile of the paper web and the lower limit for the drawing window is defined on the basis of the maximum value for the moisture profile of the paper web.

3. A method as claimed in claim 1, wherein the upper limit for the drawing window is the minimum value for moisture of the paper web and the lower limit for the drawing window is the maximum value for moisture of the paper web.

4. A method as claimed in claim 1, wherein the moisture profile of the paper web is defined from the mean value of two or more series of moisture values measured along the entire width of the paper web.

5. A method as claimed in claim 1, wherein the operational groups each comprise at least one runnability component driven by an electric motor, and wherein the speed difference between the operational groups is adjusted by changing the relative rotation speed of the electric motors.

6. A method as claimed in claim 1, wherein at least one of the operational groups is part of a paper web finishing apparatus and the paper finishing apparatus comprises one of a coating machine, a winder or a sheet cutter, or a printing machine.

7. A method in connection with drawing a paper web through at least two operational groups each associated with a paper machine or a paper web finishing apparatus, said method comprising;

measuring a variable representing runnability of the paper web, defining a moisture profile of the paper web substantially along the entire width of the paper web, defining minimum and maximum values for moisture on the basis of the moisture profile, defining a drawing window having lower and upper limits describing the allowable tension to be drawn on the paper web, the lower and upper limits of the drawing window being defined on the basis of the minimum and maximum values for moisture, and adjusting the speed difference between the operational groups on the basis of the measurement of said variable so that the paper web tension is within the range defined by the drawing window.

8. Equipment in connection with drawing a paper web through at least two operational groups each associated with a paper machine or a paper web finishing apparatus, said equipment comprising;

at least one moisture measuring device for measuring a moisture profile of the paper web substantially along the entire width of the paper web, means for defining minimum and maximum values for moisture on the basis of the moisture profile, means for defining a drawing window having lower and upper limits describing the allowable tension to be drawn on the paper web, the lower and upper limits of the drawing window being arranged to be defined on the basis of the minimum and maximum values for moisture, and means for adjusting the speed difference between the operational groups on the basis of the moisture of the paper web so that the paper web tension is within the range defined by the drawing window.

9. Equipment as claimed in claim 8, wherein the upper limit for the drawing window is arranged to be defined on the basis of the minimum value for the moisture profile of the paper web and the lower limit for the drawing window is arranged to be defined on the basis of the maximum value for the moisture profile of the paper web.

10. Equipment as claimed in claim 8, wherein the upper limit for the drawing window is the minimum value for moisture of the paper web and the lower limit for the drawing window is the maximum value for moisture of the paper web.

11. Equipment as claimed in claim 8, wherein the moisture measuring device is a mini-traversing measuring device based on reflection measurement, arranged to measure the paper web moisture substantially simultaneously along the entire width of the paper web.

12. Equipment as claimed in claim 8, wherein the measuring device is configured to measure two or more series of moisture values measured along the entire width of the paper web and the moisture profile is defined from the mean value of the series.

13. Equipment as claimed in claim 8, wherein the operational groups each comprise at least one runnability component driven by an electric motor, and wherein the speed difference between the operational groups is arranged to be adjusted by changing the relative rotation speed of the electric motors.

14. Equipment as claimed in claim 8, wherein at least one of the operational groups is part of a paper web finishing apparatus and the paper finishing apparatus comprises one of a coating machine, a winder or a sheet cutter, or a printing machine.

15. Equipment as claimed in claim 8, wherein at least two of the operational groups are in a paper machine and each comprises one of a wire section, a press section, a dryer group of a dryer section, and a reeler, and wherein the moisture measuring device is arranged between two of the operational groups.

* * * * *